US011241899B2

(12) United States Patent
Morino et al.

(10) Patent No.: US 11,241,899 B2
(45) Date of Patent: Feb. 8, 2022

(54) PACKAGE, PRINTING APPARATUS, AND PRINTING SYSTEM

(71) Applicant: Ricoh Company, Ltd., Tokyo (JP)

(72) Inventors: Tetsu Morino, Kanagawa (JP); Genta Hagiwara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/812,881

(22) Filed: Mar. 9, 2020

(65) Prior Publication Data

US 2020/0290387 A1 Sep. 17, 2020

(30) Foreign Application Priority Data

Mar. 14, 2019 (JP) ..... JP2019-047772
Feb. 7, 2020 (JP) ..... JP2020-019785

(51) Int. Cl.
*B41M 5/00* (2006.01)
*B41J 3/407* (2006.01)
*B65D 33/18* (2006.01)

(52) U.S. Cl.
CPC ..... *B41M 5/0017* (2013.01); *B41J 3/4073* (2013.01); *B65D 33/18* (2013.01)

(58) Field of Classification Search
None
See application file for complete search history.

(56) References Cited

U.S. PATENT DOCUMENTS

2014/0182432 A1* 7/2014 Muto ..... B26D 5/005 83/76.7
2015/0239261 A1 8/2015 Sugiyama et al.
2016/0214410 A1* 7/2016 Hamada ..... B41J 11/06
2017/0058453 A1* 3/2017 Pan ..... D06P 5/2072

FOREIGN PATENT DOCUMENTS

JP 2001-187467 7/2001
JP 2009-135143 6/2009
JP 5382455 10/2013
JP 2015-161043 9/2015
JP 2018-090944 6/2018

* cited by examiner

*Primary Examiner* — Erica S Lin
(74) *Attorney, Agent, or Firm* — Xsensus LLP

(57) ABSTRACT

A package includes a print target material on which printing is to be performed by a printing apparatus. The package includes a plate-like member, a positioning target portion, and an opening portion. The plate-like member configured to hold a portion on which printing is to be performed, of the print target material to cause the portion to be flat. The positioning target portion is arranged in the plate-like member and configured to engage with a positioning member configured to position the print target material with respect to a printing position in the printing apparatus. A portion of a printing region of the print target material is opened in the opening portion.

15 Claims, 9 Drawing Sheets

PACKAGE, PRINTING APPARATUS, AND PRINTING SYSTEM

CROSS-REFERENCE TO RELATED APPLICATIONS

The present application claims priority under 35 U.S.C. § 119 to Japanese Patent Application No. 2019-047772, filed on Mar. 14, 2019 and Japanese Patent Application No. 2020-019785, filed on Feb. 7, 2020. The contents of which are incorporated herein by reference in their entirety.

BACKGROUND OF THE INVENTION

1. Field of the Invention

The present invention relates to a package, a printing apparatus, and a printing system.

2. Description of the Related Art

Conventionally, an inkjet printer that prints an image on a fabric (including a processed product, such as a T-shirt or a bag) as a print target material (recording medium) has been known.

For example, Japanese Unexamined Patent Application Publication No. 2001-187467 discloses a printing apparatus that includes a print box for storing a fabric such that a part of the fabric is exposed, and performs printing on the fabric that is stored in the print box in an exposed manner.

However, according to the conventional printing apparatus that performs printing on a fabric, it is necessary to completely unpack a package (individual package) of each of fabric products, such as T-shirts, set the fabric product in the print box, and thereafter perform printing, which takes time and effort.

SUMMARY OF THE INVENTION

According to an aspect of the present invention, a package includes a print target material on which printing is to be performed by a printing apparatus. The package includes a plate-like member, a positioning target portion, and an opening portion. The plate-like member configured to hold a portion on which printing is to be performed, of the print target material to cause the portion to be flat. The positioning target portion is arranged in the plate-like member and configured to engage with a positioning member configured to position the print target material with respect to a printing position in the printing apparatus. A portion of a printing region of the print target material is opened in the opening portion.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
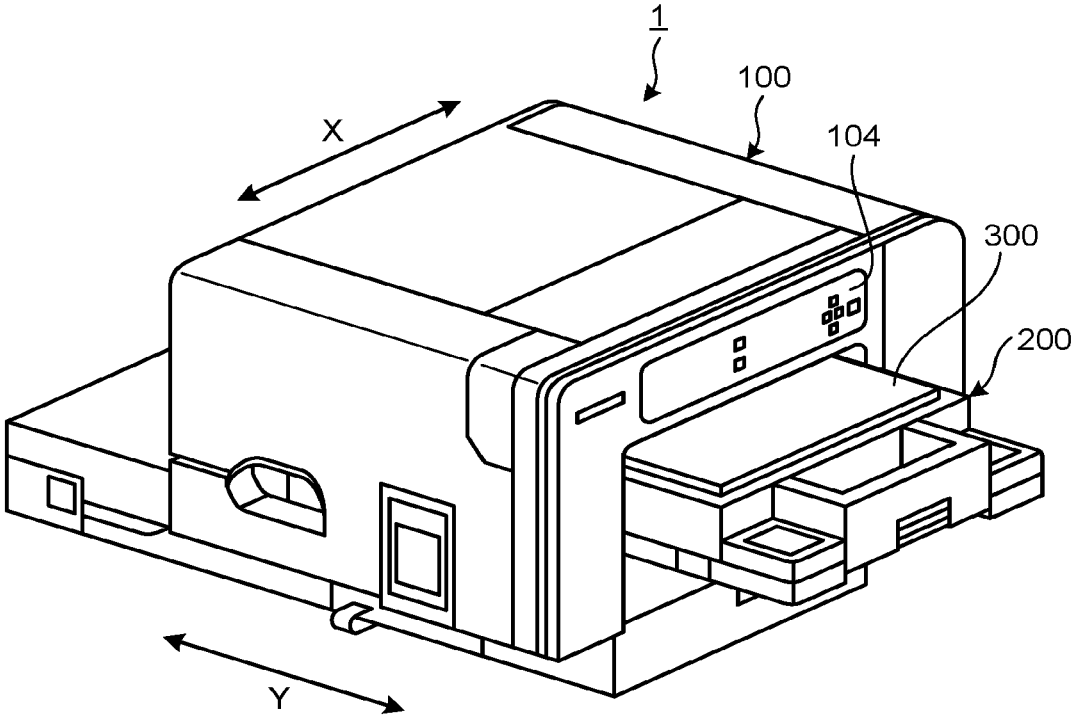
FIG. 1 is an external perspective view of a printing apparatus according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a package, a printing apparatus, and a printing system capable of promptly performing printing on a print target material.

Exemplary embodiments of a package, a printing apparatus, and a printing system will be described in detail below with reference to the accompanying drawings.

In the present embodiment, a serial-type inkjet printer is applied as a printing apparatus. More specifically, an inkjet printer that adopts a fabric (including a processed product, such as a T-shirt or a bag) as a print target material (recording medium) is applied as the printing apparatus.

First Embodiment

Figure 2:
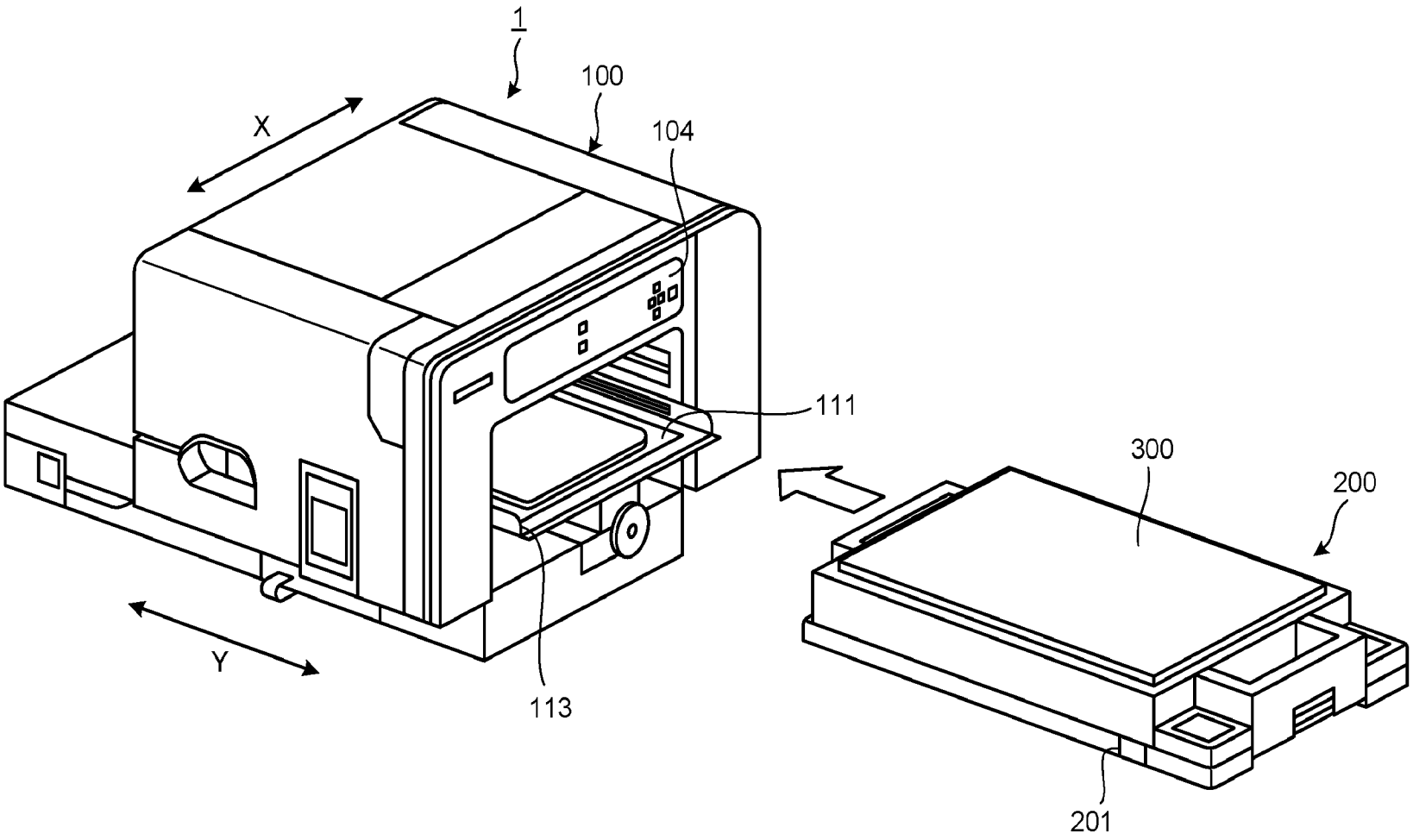
FIG. 2 is an exploded perspective view of the printing apparatus.

FIG. 1 is an external perspective view of a printing apparatus 1 according to a first embodiment. FIG. 2 is an exploded perspective view of the printing apparatus 1.

The printing apparatus 1 applies an image onto a fabric 400 (see FIG. 6A) that is a print target material (recording medium). As illustrated in FIG. 1 and FIG. 2, the printing apparatus 1 includes an apparatus main body 100 and a cassette 200.

The cassette 200 is a tray for holding the fabric 400 that is a target onto which an image is applied (printed). The cassette 200 includes a cassette base 201 as a base member and a platen member 300 as a platen that holds a portion of the fabric 400 on which printing is performed, to cause the portion to be flat.

Meanwhile, as the fabric 400, it is possible to use a single piece of fabric, such as a handkerchief or a towel, a fabric that is processed into clothes, such as a T-shirt or a sweat shirt, and a fabric that constitutes a part of a product, such as a tote bag.

The printing apparatus 1 includes a stage 111 and a printing unit 112 (see FIG. 3) inside the apparatus main body 100. The stage 111 is a receiving member that holds the cassette 200 in a removable manner and moves the cassette 200 back and forth. The printing unit 112 performs printing on the fabric 400 that is held by the cassette 200 held on the stage 111.

The stage 111 is arranged on a conveying unit 113 and held such that the stage 111 can move in a direction of arrow Y (sub-scanning direction) relative to the apparatus main body 100.

Further, the printing apparatus 1 includes an operation panel 104 for inputting and displaying information needed for the apparatus.

Figure 3:
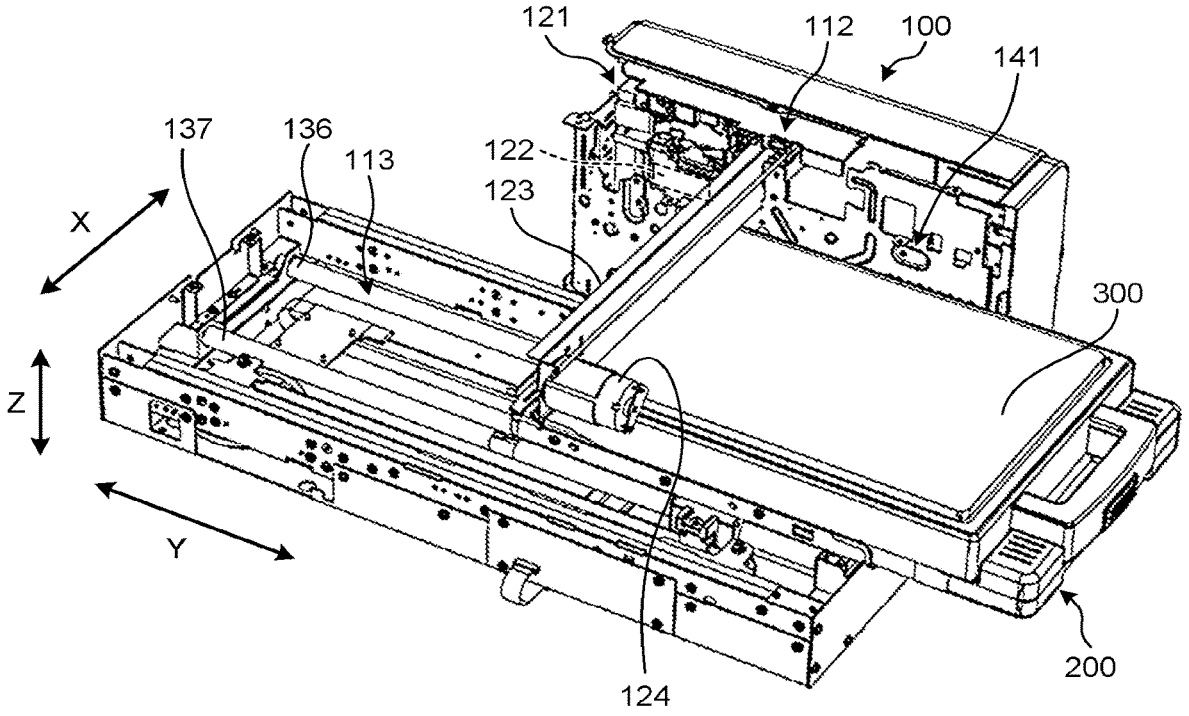
FIG. 3 is a perspective view illustrating an inside of the printing apparatus.
Figure 4:
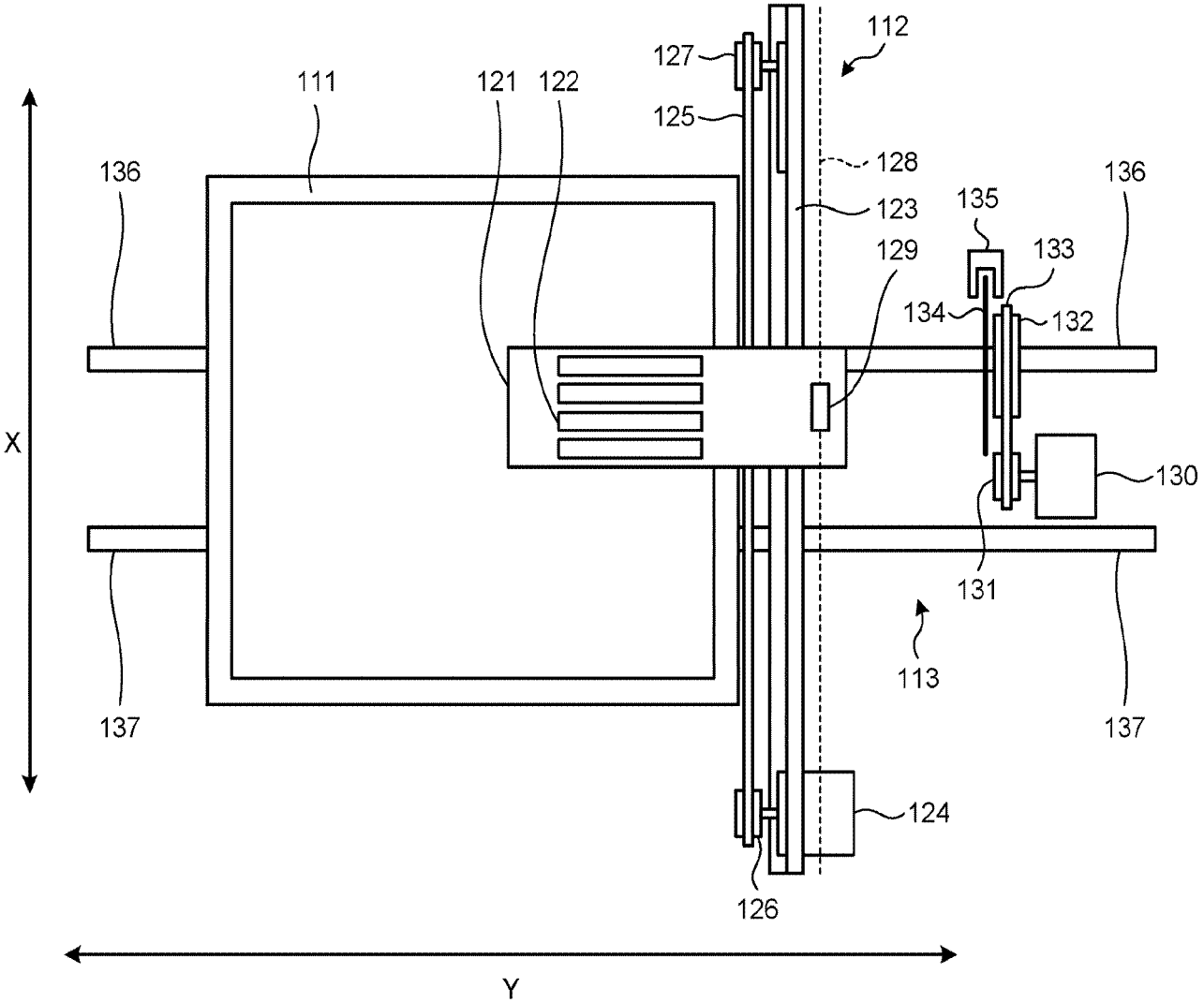
FIG. 4 is a diagram schematically illustrating configurations of a printing unit and a conveying unit.

FIG. 3 is a perspective view illustrating an inside of the printing apparatus 1. FIG. 4 is a diagram schematically illustrating configurations of the printing unit 112 and the conveying unit 113.

As illustrated in FIG. 3 and FIG. 4, the printing unit 112 includes a carriage 121 that moves in a direction of arrow X (main-scanning direction) relative to the stage 111 and a recording head 122 that is mounted on the carriage 121.

The carriage 121 is held, in a movable manner, by a guide member 123 that is arranged along the direction of arrow X (main-scanning direction). The carriage 121 reciprocates in the direction of arrow X (main-scanning direction) via a timing belt 125 that is extended between a drive pulley 126 that is rotated by a main-scanning motor 124 and a driven pulley 127.

The recording head 122 includes four liquid discharge heads that discharge ink droplets of four colors, such as yellow (Y), cyan (C), magenta (M), and black (K). The recording head 122 is mounted such that nozzle arrays in each of which a plurality of ink discharge outlets (nozzles) are formed on a nozzle surface are arranged in a direction (the direction of arrow Y (sub-scanning direction)) perpendicular to the direction of arrow X (main-scanning direction) and such that the ink discharge outlets are oriented downward.

Meanwhile, ink of each of the colors is sent from an ink cartridge that is set in an ink supply unit (not illustrated) arranged inside the apparatus main body 100 to a sub tank (not illustrated) that is a temporary storage place located immediately above the recording head 122, by using a liquid feed pump. Ink in the sub tank is supplied to the recording head 122 in accordance with consumption in the recording head 122.

Meanwhile, while the recording head 122 uses an independent droplet discharge head for each of the colors, embodiments are not limited to this example. For example, the recording head 122 may be configured as one or more heads, each including a plurality of nozzle arrays for discharging droplets of recording liquid for different colors. Further, the number and the arrangement order of the colors are not limited to this example.

As the recording head 122, it is possible to use a mechanism that includes, as a pressure generating unit that generates pressure for discharging droplets, a piezoelectric actuator such as a piezoelectric element, a thermal actuator that uses a phase change due to film boiling of liquid by using an electro-thermal conversion element such as a thermal resistance element, a shape-memory-alloy actuator that uses a metal phase change due to a temperature change, or an electrostatic actuator that uses an electrostatic force.

Further, the printing unit 112 includes an encoder scale 128 that has a slit and that is arranged along the direction of arrow X (main-scanning direction). The carriage 121 includes an encoder sensor 129 that detects the slit of the encoder scale 128. The encoder scale 128 and the encoder sensor 129 constitute a linear encoder for detecting a position of the carriage 121 in the direction of arrow X (main-scanning direction).

With this configuration, the printing unit 112 discharges ink droplets and performs printing at a desired position in accordance with movement of the carriage 121.

The conveying unit 113 horizontally moves the stage 111, which holds the cassette 200 in a removable manner, in the direction of arrow Y (sub-scanning direction) along conveying guide members 136 and 137. The conveying guide member 136 includes a conveying roller pulley 132 that is rotated by a sub-scanning motor 130. Further, the conveying unit 113 rotates the conveying guide member 136 via a timing belt 133 that is extended between a conveying drive pulley 131 and the conveying roller pulley 132 that are rotated by the sub-scanning motor 130, and reciprocates in the direction of arrow Y (sub-scanning direction) on the stage 111.

The conveying unit 113 includes an encoder wheel 134, in which the slit is formed and which is arranged coaxially with the conveying roller pulley 132. Further, the conveying unit 113 includes an encoder sensor 135 that detects the slit of the encoder wheel 134. The encoder wheel 134 and the encoder sensor 135 constitute a wheel encoder for detecting a position of the stage 111 in the direction of arrow Y (sub-scanning direction).

Furthermore, the conveying unit 113 includes an elevator unit (not illustrated) including an elevator motor that moves the stage 111 up and down, and a height detection sensor 141 (see FIG. 3) that detects a position of the stage 111 (the cassette 200) that is moved up and down by the elevator unit in a Z-direction.

With this configuration, in the printing apparatus 1, the cassette 200 is attached to and held on the stage 111 inside the apparatus main body 100 in a state in which the fabric 400 is set in the cassette 200. Then, by repeating movement of the stage 111 in the direction of arrow Y (sub-scanning direction) and reciprocation of the recording head 122 in the direction of arrow X (main-scanning direction), a desired image is printed on the fabric 400.

A holding mode of the fabric 400 will be described below. In the present embodiment, the fabric 400 is packaged in a predetermined shape by using a package. The package includes a fabric holding member 500 (see FIG. 5A etc.) that holds the fabric 400 and a package bag 600 (see FIG. 7B etc.). The package constitutes a printing system, together with the printing apparatus 1.

Figure 5A:
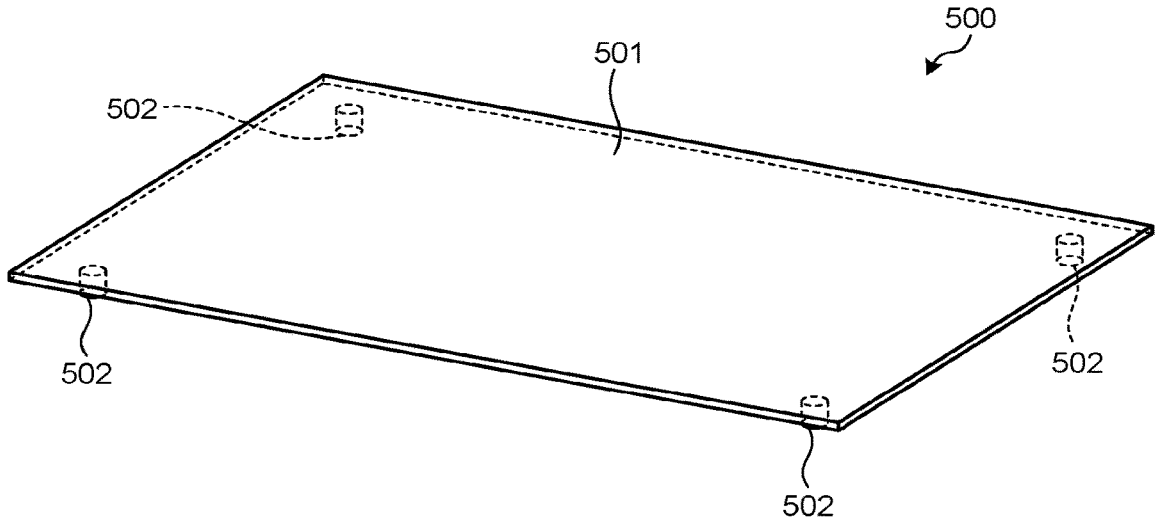
FIG. 5A is a perspective view illustrating a top side of a fabric holding member for holding a printing side of a fabric.
Figure 5B:
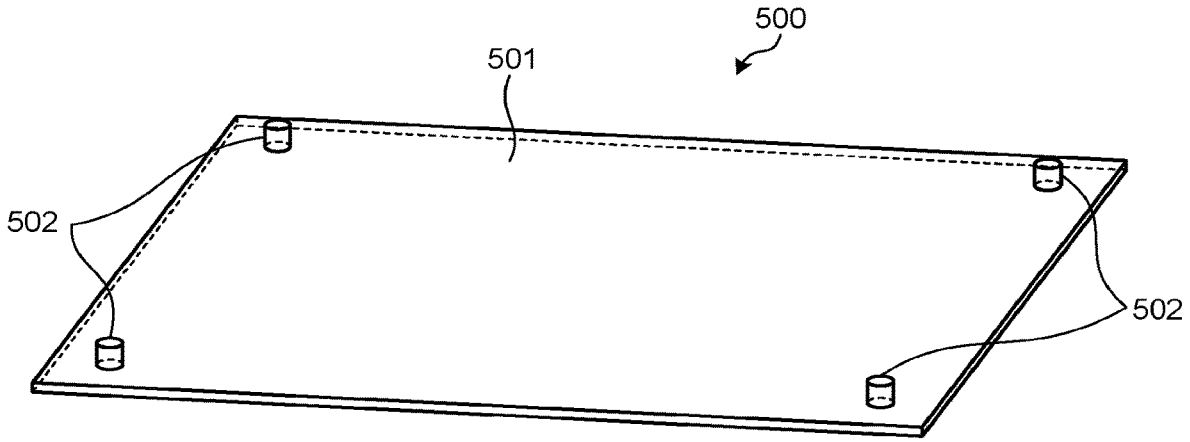
FIG. 5B is a perspective view illustrating a back side of the fabric holding member.

FIG. 5A is a perspective view illustrating a top side of the fabric holding member 500 for holding a printing side of the fabric 400. FIG. 5B is a perspective view illustrating a back side of the fabric holding member 500. As illustrated in FIG. 5A and FIG. 5B, the fabric holding member 500 includes a plate-like member 501 that has a flat plate shape, and four leg portions 502 that have cylindrical shapes and that serve as positioning target portions arranged in the plate-like member 501.

The plate-like member 501 is a member for reducing wrinkle and floating of the printing side of the fabric 400 (in this example, T-shirt) to be printed. By flattening the printing side of the fabric 400 as much as possible, it becomes possible to prevent variation in a distance to the recording head 122 and make the distance to the recording head 122 constant, so that it becomes possible to improve printing quality.

The plate-like member 501 is heat resistant at heating temperature (fixing temperature) when ink applied onto the fabric 400 is thermally fixed. The heating temperature (fixing temperature) is about 70 to 150 degrees. For example, as a material of the plate-like member 501, it may be possible to use heat-resistant sponge rubber made of silicon rubber or fluoro-rubber, various kinds of heat-resistant resin, a felt, a silicate calcium board, KALHON, KALLYTE, plasterboard, melamine sponge, glass wool, glass, or the like.

The leg portions 502 of the fabric holding member 500 are members that come into contact with the platen member 300 at the time of printing, and maintain a constant distance between the platen member 300 and the printing side of the fabric 400 held by the fabric holding member 500. By maintaining a constant interval between the printing side of the fabric 400 and the recording head 122 in a horizontal manner, it is possible to prevent variation in the distance to the recording head 122 and make the distance to the recording head 122 constant, so that it is possible to improve printing quality.

Meanwhile, in the fabric holding member 500 of the present embodiment, the four leg portions 502 having cylindrical shapes are arranged on the plate-like member 501, but embodiments are not limited to this example as long as it is possible to maintain the constant distance between the platen member 300 and the printing side of the fabric 400 held by the fabric holding member 500. For example, it may be possible to use the four or more leg portions 502 for supporting, use the three leg portions 502 that serve as three vertices of a triangle for supporting, or use the one or two leg portions 502 with large contact areas. In other words, the positioning target portion is one or more leg portions 502.

Figure 6A:
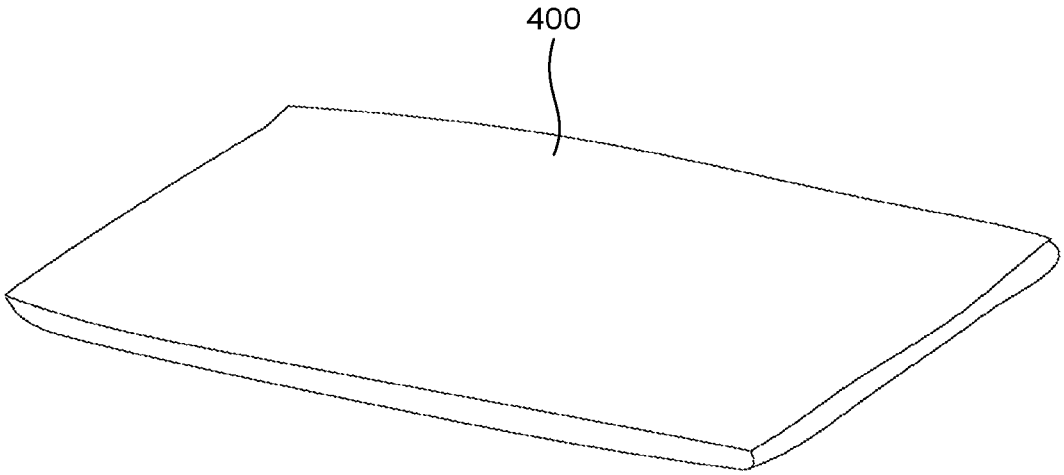
FIG. 6A is a perspective view illustrating the printing side of the fabric held by the fabric holding member.
Figure 6B:
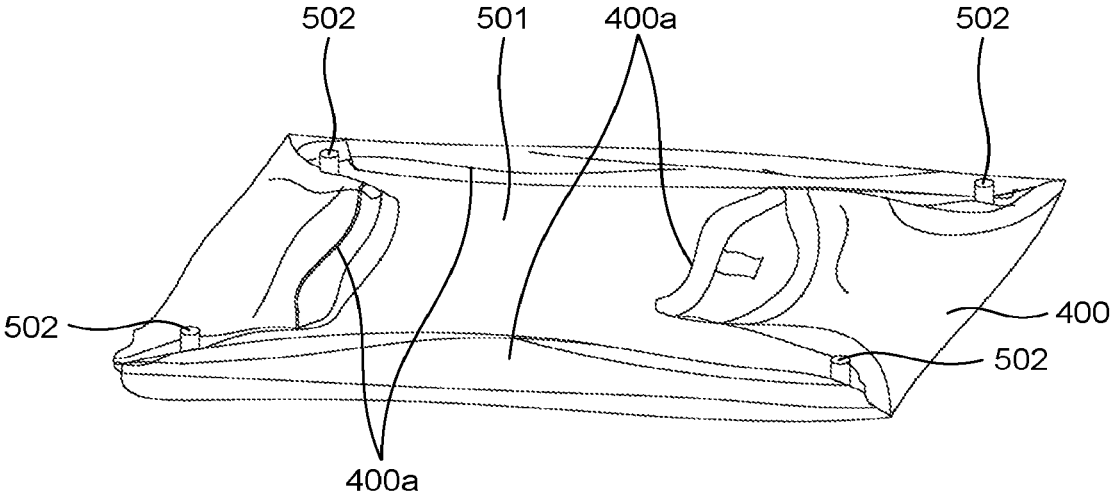
FIG. 6B is a perspective view illustrating the fabric holding member in FIG. 6A, when viewed from a back surface.

FIG. 6A is a perspective view illustrating the printing side of the fabric 400 held by the fabric holding member 500. FIG. 6B is a perspective view illustrating the fabric holding member 500 in FIG. 6A, when viewed from a back surface.

As illustrated in FIG. 6B, the fabric holding member 500 is placed at the side of the back surface (a surface opposite to a surface to be printed) of the fabric 400 (in this example, a T-shirt) to be printed. Thereafter, remaining portions 400*a* of the fabric 400 protruding from the fabric holding member 500 are folded toward the back side of the fabric holding member 500, so that the state as illustrated in FIG. 6B is obtained. The remaining portions 400*a* correspond to, for example, sleeves, a collar, a hem, and the like when printing is performed on a front surface of a T-shirt. Meanwhile, the remaining portions 400*a* may be temporarily fixed to the plate-like member 501 with a tape or the like. When the fabric holding member 500 in this state is turned upside down, the state as illustrated in FIG. 6A is obtained.

Here, as illustrated in FIG. 6A, the fabric 400 (in this example, a T-shirt) is brought into close contact with a side (top side) where the leg portions 502 are not arranged in the plate-like member 501, in such a manner that wrinkle and floating does not occur. This is done to maintain the constant distance between the recording head 122 and the fabric 400 at the time of printing. If wrinkle or floating occurs in the fabric 400, a partial height difference may occur, so that the distance between the recording head 122 and the fabric 400 is partially changed, and it becomes difficult to maintain constant printing quality.

Meanwhile, as described above, the remaining portions 400*a* of the fabric 400 protruding from the fabric holding member 500 are folded toward the back side of the fabric holding member 500. In this case, it is necessary that a height of the folded remaining portions 400*a* falls within a range lower than the leg portions 502 of the fabric holding member 500. This is because, if the height becomes higher than the leg portions 502 of the fabric holding member 500, the platen member 300 does not come into contact with the leg portions 502, so that a height between the recording head 122 and a printing surface does not fall within an appropriate range.

Further, for the same reason, it is necessary that the fabric 400 does not overlap surfaces of the leg portions 502 of the fabric holding member 500, where the surfaces come into contact with the platen member 300.

Figure 7A:
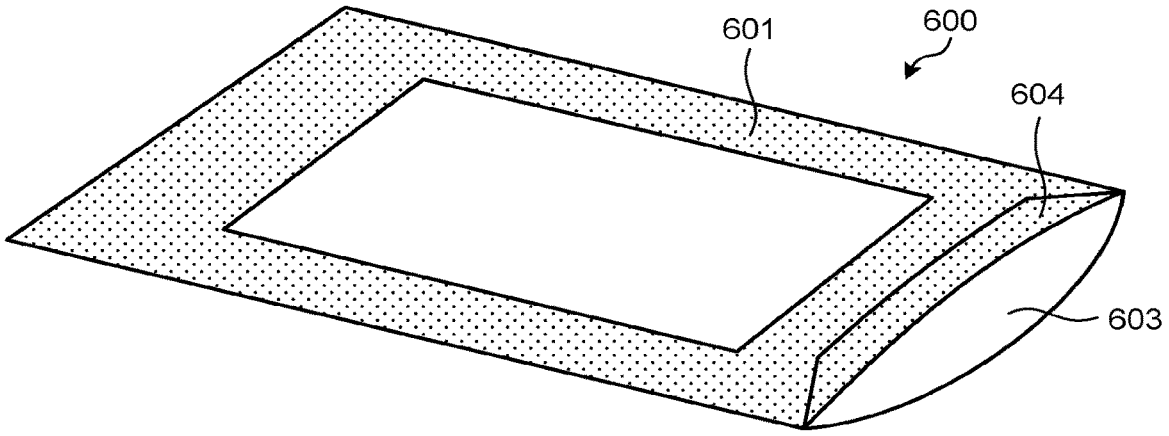
FIG. 7A is a perspective view of a package bag.
Figure 7B:
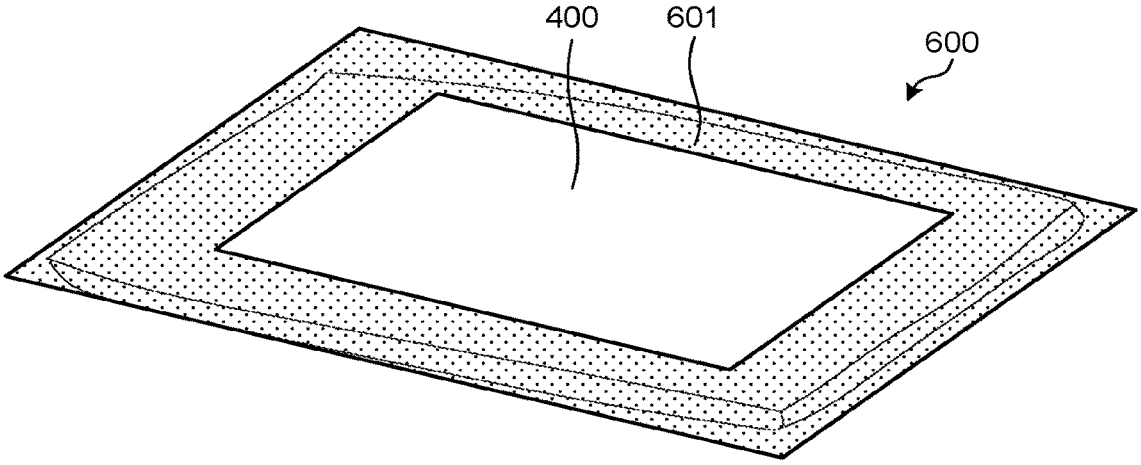
FIG. 7B is a perspective view illustrating the printing side of the fabric that is packaged in the package bag.
Figure 7C:
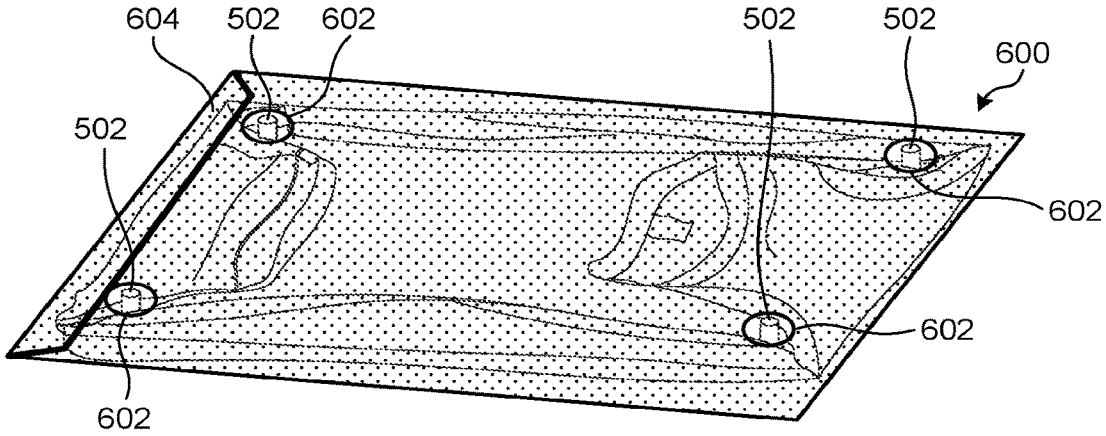
FIG. 7C is a perspective view of the fabric in a packaged state in FIG. 7B, when viewed from a back surface.

In addition, in the present embodiment, the fabric 400 is packaged in the package bag 600 while being held by the fabric holding member 500. FIG. 7A is a perspective view of the package bag 600. FIG. 7B is a perspective view illustrating the printing side of the fabric 400 that is packaged in the package bag 600. FIG. 7C is a perspective view of the fabric 400 in a packaged state in FIG. 7B, when viewed from the back surface.

The package bag 600 is made with paper, a resin film, or the like, is formed in an envelope shape, and has a space for storing the entire fabric 400 held by the fabric holding member 500. An insertion portion 603 for inserting the fabric 400 held by the fabric holding member 500 is arranged in one end portion of the package bag 600. The insertion portion 603 of the package bag 600 is sealed using a sealing member 604 after the fabric 400 held by the fabric holding member 500 is stored. The sealing member 604 is, for example, a flap to which an adhesive is applied.

The package bag 600 is heat resistant at heating temperature (fixing temperature) when ink applied onto the fabric 400 is thermally fixed. The heating temperature (fixing temperature) is about 70 to 150 degrees.

As illustrated in FIG. 7B, the package bag 600 includes an opening portion 601 in which a portion corresponding to a printing region is opened, at the side of the printing side of the fabric 400. Further, as illustrated in FIG. 7C, the package bag 600 includes leg exposing portions 602 at positions corresponding to the leg portions 502 of the fabric holding member 500 on the side opposite to the printing side of the fabric 400. The leg exposing portions 602 are opening portions. The package bag 600 in which the fabric 400 and the fabric holding member 500 are contained allows the leg portions 502 of the fabric holding member 500 to be exposed from the leg exposing portions 602 formed as the opening portions.

Meanwhile, a pre-treatment agent for improving fixing performance and chromogenic property of ink is applied, in advance, to the fabric 400 packaged in the package bag 600. The pre-treatment agent contains, for example, a coagulant (a multivalent metal salt, an organic acid, a cationic compound, or the like). By applying, in advance, the pre-treatment agent for the ink to the fabric 400 packaged in the package bag 600, it is possible to omit operation of applying the pre-treatment agent before printing, so that it is possible to perform printing immediately.

With this configuration, if printing is performed upon receiving an order from a customer at a store for example, it is possible to reduce a time taken to complete printing on the fabric 400, so that it is possible to reduce a customer's waiting time.

The platen member 300 will be described below.

Figure 8:
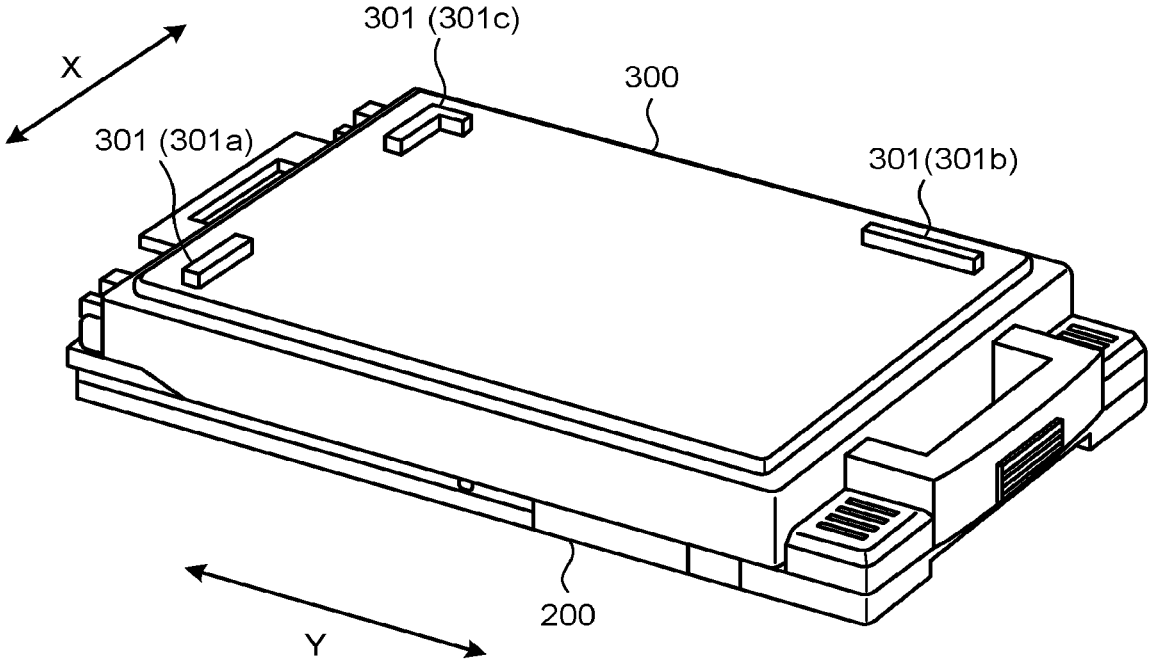
FIG. 8 is a perspective view of a platen member on a cassette.

FIG. 8 is a perspective view of the platen member 300 on the cassette 200. As illustrated in FIG. 8, the platen member 300 includes, on a top surface, positioning members 301 for positioning the package bag 600 in the direction of arrow X (main-scanning direction) and the direction of arrow Y (sub-scanning direction), with respect to a printing position on the cassette 200. The positioning members 301 are formed as protrusions from the platen member 300. More specifically, as illustrated in FIG. 8, the positioning members 301 include protrusions 301*a* to 301*c* that engage with the leg portions 502 of the fabric holding member 500 exposed from the leg exposing portions 602 of the package bag 600 and that are arranged at three positions in accordance with the leg portions 502.

Meanwhile, heights of the protrusions 301*a* to 301*c* arranged at the three positions are lower than the heights of the leg portions 502 of the fabric holding member 500. In other words, the heights of the leg portions 502 of the fabric holding member 500 are set to be higher than the height of the positioning members 301 (the protrusions 301*a* to 301*c*). This is because, if the heights of the protrusions 301*a* to 301*c* are higher than the heights of the leg portions 502 of the fabric holding member 500, the leg portions 502 do not come into contact with the platen member 300, so that the height between the recording head 122 and the printing surface does not fall within an appropriate range.

The protrusion 301*a* has a rectangular solid shape and positions the package bag 600 in the direction of arrow X (main-scanning direction). The protrusion 301*b* has a rectangular solid shape and positions the package bag 600 in the direction of arrow Y (sub-scanning direction). The protrusion 301*c* has a shape that is obtained by connecting two rectangular solids in an L-shape, and positions the package bag 600 in the direction of arrow X (main-scanning direction) and the direction of arrow Y (sub-scanning direction).

Meanwhile, in the present embodiment, as illustrated in FIG. 8, the positioning members 301 are formed of the protrusions 301*a* to 301*c* that are arranged at the three positions and that protrude from the platen member 300; however, embodiments are not limited to this example, and the number of the protrusions may be arbitrary as long as it is possible to position the package bag 600 in the direction of arrow X (main-scanning direction) and the direction of arrow Y (sub-scanning direction). Further, the shapes of the protrusions 301*a* to 301*c* are not limited to the shapes as illustrated in FIG. 8. Furthermore, the positioning members 301 need not always be formed as the protrusions from the platen member 300, but may be formed in recessed shapes or the like.

A method of mounting the package bag 600, in which the fabric 400 is packaged, onto the cassette 200 will be described below.

Figure 9:
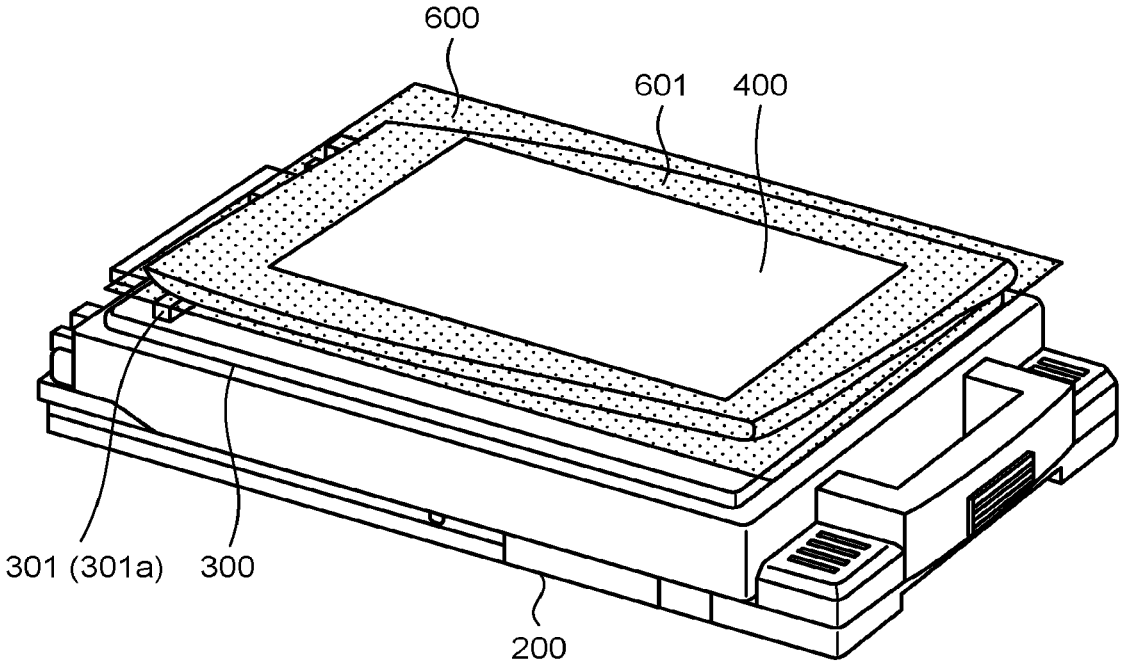
FIG. 9 is a perspective view illustrating a state in which the package bag in which the fabric is packaged is placed on the cassette.

FIG. 9 is a perspective view illustrating a state in which the package bag 600 in which the fabric 400 is packaged is placed on the cassette 200. The package bag 600 in which the entire fabric 400 held by the fabric holding member 500 is packaged is placed such that the leg portions 502 of the fabric holding member 500 come into abutting contact with the positioning members 301 of the platen member 300 on the cassette 200. With this configuration, the package bag 600 is positioned at the printing position on the cassette 200. The cassette 200 on which the package bag 600 containing the fabric 400 is positioned is mounted on the apparatus main body 100. Then, the printing apparatus 1 performs printing on the fabric 400 for which a printing region is determined by the opening portion 601 of the package bag 600.

A flow of a printing process performed by the printing apparatus 1 will be simply described below.

First, a user removes the cassette 200 from the apparatus main body 100. Subsequently, the user places the package bag 600, in which the entire fabric 400 held by the fabric holding member 500 is packaged, by bringing the leg portions 502 of the fabric holding member 500 into abutting contact with the positioning members 301 of the platen member 300.

Then, the user mounts the cassette 200, on which the package bag 600 is positioned, onto the apparatus main body 100. The printing apparatus 1 starts printing on the fabric 400 for which the printing region is determined by the opening portion 601 of the package bag 600.

The printing apparatus 1 draws the cassette 200 to the inside and moves the cassette 200 to a printing start position. At this time, the printing apparatus 1 also controls a Z-axis (height direction) by using the height detection sensor 141 such that an interval between the recording head 122 and the cassette 200 is set to an appropriate interval.

Thereafter, the printing apparatus 1 moves the carriage 121 to the printing start position and starts to discharge ink. The printing apparatus 1 also moves the stage 111 (the cassette 200) by a predetermined amount every time the carriage 121 completes a single scan. The printing apparatus 1 performs printing operation on the entire printing area by alternately moving the carriage 121 and the stage 111 (the cassette 200) as described above.

After the print operation is completed, the user removes the cassette 200 from the apparatus main body 100, and further removes, from the cassette 200, the package bag 600 in which the entire fabric 400 held by the fabric holding member 500 is packaged. Then, the user performs thermal fixing of ink applied on the fabric 400 and terminates the printing process.

As described above, according to the present embodiment, the opening portion 601, in which the printing region of the fabric 400 that is held by the plate-like member 501 in a flat state is opened, is arranged in the package bag 600, and the leg portions 502 corresponding to the positioning members 301 for positioning the platen member 300 are arranged on the plate-like member 501 and exposed from the leg exposing portions 602 of the package bag 600. Then, the package bag 600, in which the entire fabric 400 held by the fabric holding member 500 is packaged, is placed such that the leg portions 502 exposed from the leg exposing portions 602 of the package bag 600 come into abutting contact with the positioning members 301 of the platen member 300, so that the package bag 600 can be positioned at the printing position on the platen member 300. With this configuration, only by placing the fabric 400 that is packaged in the package bag 600 on the platen member 300 of the printing apparatus 1 without unpacking the fabric product, such as a T-shirt, it is possible to promptly perform printing on the fabric 400 with high quality and a simple structure.

Second Embodiment

A second embodiment will be described below.

The second embodiment is different from the first embodiment in that a protecting member that covers the opening formed in the opening portion 601 of the package bag 600 is provided. Hereinafter, in the description of the second embodiment, explanation of the same components as those of the first embodiment will be omitted, and different components from those of the first embodiment will be described.

Figure 10:
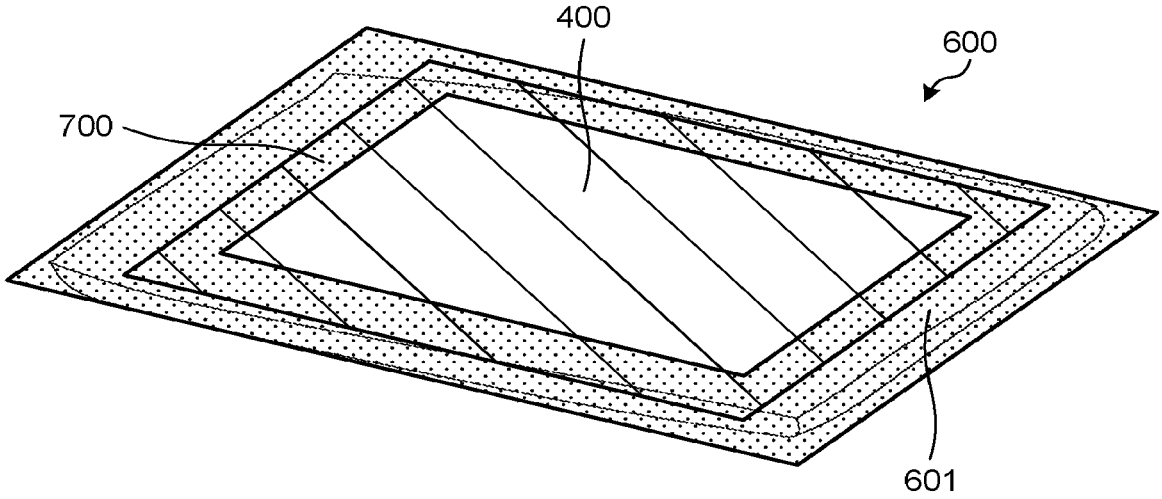
FIG. 10 is a perspective view illustrating a printing side of a fabric that is packaged in a package bag according to a second embodiment.

FIG. 10 is a perspective view illustrating the printing side of the fabric 400 that is packaged in the package bag 600 according to the second embodiment. As illustrated in FIG. 10, the package bag 600 includes a sheet-like protecting member 700 that covers the opening formed in the opening portion 601 in order to prevent dirt from sticking during transportation or the like. The protecting member 700 is attached to the opening portion 601 of the package bag 600 with a re-peelable and re-stickable adhesive.

The protecting member 700 is peeled off from the package bag 600 before printing on the fabric 400 is performed, to thereby prevent the printing side of the fabric 400 from being exposed until just before the printing and reduce the possibility that the printing side of the fabric 400 gets dirty.

The protecting member 700 is re-peelable and re-stickable and therefore is attached again at a position at which the opening formed in the opening portion 601 of the package bag 600 is covered, after the printing on the fabric 400 is completed. With this configuration, it is possible to prevent a print completed surface of the fabric 400 from getting dirty. In particular, by allowing the protecting member 700 to be attached again at the position at which the opening formed in the opening portion 601 of the package bag 600 is covered, it is possible to prevent the print completed surface of the fabric 400 from getting dirty or the like when a customer brings the material printed at a store back home, which is extremely effective.

Meanwhile, in each of the embodiments as described above, the example has been described in which the printing apparatus of the present invention is applied to the printing apparatus 1 that applies an image onto a fabric, but it is possible to apply the present invention to any image forming apparatus, such as a multifunction peripheral having at least two of a copier function, a printer function, a scanner function, and a facsimile function, a copier, a printer, a scanner apparatus, or a facsimile machine.

In each of the embodiments as described above, the case has been described in which the fabric 400 is a T-shirt or the like, but the present invention may be applied to, in the same manner, a case in which a medium, including a fabric, is used as a print target material. In this case, the "fabric" in each of the embodiments described above is replaced with a medium.

According to an embodiment, it is possible to promptly perform printing on a fabric with high quality and a simple structure.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A package including a print target material on which printing is to be performed by a printing apparatus, the package comprising:

a plate-like member configured to hold a portion of the print target material on which printing is to be performed such that the portion of the print target material is flat;

a positioning target portion arranged in the plate-like member and configured to engage with a positioning member configured to position the print target material with respect to a printing position in the printing apparatus; and a package bag in which the print target material held by the plate-like member and the plate-like member are contained, wherein the package bag includes an opening portion in which a portion of a printing region of the print target material is opened at a printing side of the print target material.

2. The package according to claim 1, wherein the positioning target portion comprises one or more leg portions.

3. The package according to claim 2, wherein the package bag includes a leg exposing portion configured to expose the leg portion in a state where the plate-like member is contained.

4. The package according to claim 3, wherein the package bag is formed in an envelope shape.

5. The package according to claim 1, wherein the positioning target portion is configured to maintain a constant distance between a printing side of the print target material held by the plate-like member and a platen on which the print target material is placed in the printing apparatus.

6. The package according to claim 1, wherein the package bag includes a peelable protecting member configured to cover an opening formed in the opening portion.

7. The package according to claim 6, wherein the protecting member is attached using a re-peelable and re-stickable adhesive.

8. The package according to claim 1, wherein a pre-treatment agent for ink used in the printing apparatus is applied to the print target material.

9. A printing apparatus comprising:

a platen on which the package according to claim 1 is placed, the package packing the print target material;

a positioning member arranged on the platen and configured to engage with the positioning target portion to position the package packing the print target material; and a printing unit configured to perform printing on the package placed on the platen.

10. The printing apparatus according to claim 9, wherein the positioning member is formed to protrude from the platen, and a height of the positioning target portion is higher than a height of the positioning member.

11. The printing apparatus according to claim 9, wherein a pre-treatment agent for ink used in the printing unit is applied to the print target material.

12. A printing system comprising:

the package according to claim 1, the package packing a print target material to be printed;

a platen on which the package is placed;

a positioning member arranged on the platen and configured to engage with the positioning target portion to position the package packing the print target material; and a printing unit configured to perform printing on the package placed on the platen.

13. The printing system according to claim 12, wherein the positioning member is formed to protrude from the platen, and a height of the positioning target portion is higher than a height of the positioning member.

14. The printing system according to claim 12, wherein a pre-treatment agent for ink used in the printing unit is applied to the print target material.

15. The package according to claim 1, wherein the package bag includes an insertion portion for inserting the print target material held by the plate-like member provided at one end of the package bag, and a sealing member for sealing the insertion portion after the print target material and the plate-like member are inserted into the package bag.

* * * * *